United States Patent [19]

Cormier et al.

[11] Patent Number: 4,806,945

[45] Date of Patent: Feb. 21, 1989

[54] RECEIVING HEAD END FOR POLARIZED MICROWAVES, PARABOLIC AERIAL AND RECEIVING STATION EQUIPPED WITH SUCH A RECEIVING HEAD END

[75] Inventors: Jean-Pierre M. Cormier, Louviers; Philippe N. Horvat, Saint Pierre du Vauvray, both of France

[73] Assignee: U.S. Philips Corp., New York, N.Y.

[21] Appl. No.: 98,354

[22] Filed: Sep. 18, 1987

[30] Foreign Application Priority Data

Sep. 19, 1986 [FR] France ..... 86 13139

[51] Int. Cl.[4] ..... H01Q 19/00; H01Q 19/12

[52] U.S. Cl. ..... 343/756; 333/21 A; 343/840

[58] Field of Search ..... 333/21 A; 343/756, 786, 343/840

[56] References Cited

U.S. PATENT DOCUMENTS

| | | | |
|---|---|---|---|
| 3,720,947 | 3/1973 | Meyer et al. | 333/21 A X |
| 4,528,528 | 7/1985 | Augustin | 333/21 A |
| 4,613,836 | 9/1986 | Evans | 333/21 A X |
| 4,672,388 | 6/1987 | Grim | 333/21 A X |

*Primary Examiner*—Paul Gensler

*Attorney, Agent, or Firm*—Robert J. Kraus

[57] ABSTRACT

A receiving head end comprising only a single movable component, a front depolarizer (POM), for selecting conjugate polarized microwaves. The addition of a fixed depolarizer (POF) provides two aerial versions, one for the circular type of polarization and the other for the rectilinear type of polarization. The whole is fitted together for forming an aerial for the "public at large", simple to operate and whose shadow cast on the parabolic reflector is minimal.

5 Claims, 4 Drawing Sheets

RECEIVING HEAD END FOR POLARIZED MICROWAVES, PARABOLIC AERIAL AND RECEIVING STATION EQUIPPED WITH SUCH A RECEIVING HEAD END

BACKGROUND OF THE INVENTION

The present invention relates to a receiving head end for microwaves which simultaneously provides for different channels two conjugate polarizations, comprising along the microwave propagation axis a front depolarizer, a waveguide collector, a mode selector, a converter, and control means for alternately selecting one of these conjugate polarizations.

The present invention likewise relates to a parabolic aerial and a receiving station equipped with such a receiving head end.

This type of aerial is particularly used for receiving radio signals from a geostationary satellite, for example, television signals of which the carrier frequency lies between 10 and 13 GHZ.

The current popularization of satellite television has stimulated the search for economic use of the pass-band, which is realized more particularly by using simultaneously two orthogonal or conjugate wave polarizations for one channel and one satellite.

An aerial of the "general public" type must be suitable in the most cost-effective way, for selecting alternately either of these two wave polarizations in order to gain access to all television programs transmitted by a satellite.

The French Patent Specification Nr. 2 377 711, corresponding to U.S. Pat. 4,178,574 discloses a receiving head end in which television programm selection uses two mobile devices, that is to say, the converter and the front depolarizer.

Because of the fact that the converter is mobile, the output cable is twisted; consequently, the cable is subject to wear; as the cable is not very flexible—it is a coaxial cable—it must have a free loop which is cumbersome and, in addition, the motor to control the converter must be powerful enough to twist the cable; all these constraints result in the receiving head end being expensive and bulky which causes a mask to occur opposite the incident waves, whose shadow cast on the parabola has a detrimental effect on the reception quality.

SUMMARY OF THE INVENTION

The present invention has for its object to obviate these drawbacks.

To this end a receiving head end in accordance with the invention is characterized in that the selection control means is realized by a single rotation through an angle of $\pi/2$ of the front depolarizer which is installed capable of rotating around the said propagation axis, whereas all the other said elements of the receiving head end are fixed.

With a single rotation of the front depolarizer the selection of the two conjugate waves is realized at less cost and with an excellent quality.

The front depolarizer is light and hence easy to turn and rotate; because of this the shade cast is reduced to the bare minimum.

Such a receiving head end is arranged for receiving waves of one out of the two types of polarization, that is to say, a first type called rectilinearly polarized X, Y, or a second type called circularly polarized D, G; the rotation of the single front depolarizer actually allowing the selection of X or Y in one cause and of D or G in the other, but not the two types of waves together.

To render it suitable for use in both cases, a receiving head end in accordance with the invention is characterized in that the waveguide collector comprises a housing for installing or not installing therein a typeconverting depolarizer, whose presence or absence in the housing results in receiving the waves of one out of two types of polarization.

Thus, a receiving head end can receive and select all waves of which ever type of polarization in a more costeffective way; the fact that the type-converting depolarizer is added or not is no drawback for the domestic use by the public at large; in fact, at a given moment an aerial can only be pointed towards a single satellite or group of satellites, always emitting either X, Y or D, G, polarized waves on whatever channel, in other words, there is not a situation of X, Y and D, G polarized waves being transmitted and it is easy when installing the aerial at the user's to add the type-converting depolarizer in the aiming direction of the aerial.

Thus, a receiving head end in accordance with the invention comes in two versions, with or without the typeconverting depolarizer.

Such a receiving head end is generally used in the focus of a parabolic aerial which is installed outside, for example on the roof or on the balcony; a complete receiving station further includes internal channel selection equipment. It is particularly advantageous for the receiving head end to comprise a motor for controlling the rotary motion of the front depolarizer, and for the channel selection equipment to comprise means for controlling this motor.

BRIEF DESCRIPTION OF THE DRAWING

The present invention will further be described with respect to the following drawing Figures in which.

DESCRIPTION OF THE PREFERRED EMBODIMENTS

Figure 1:
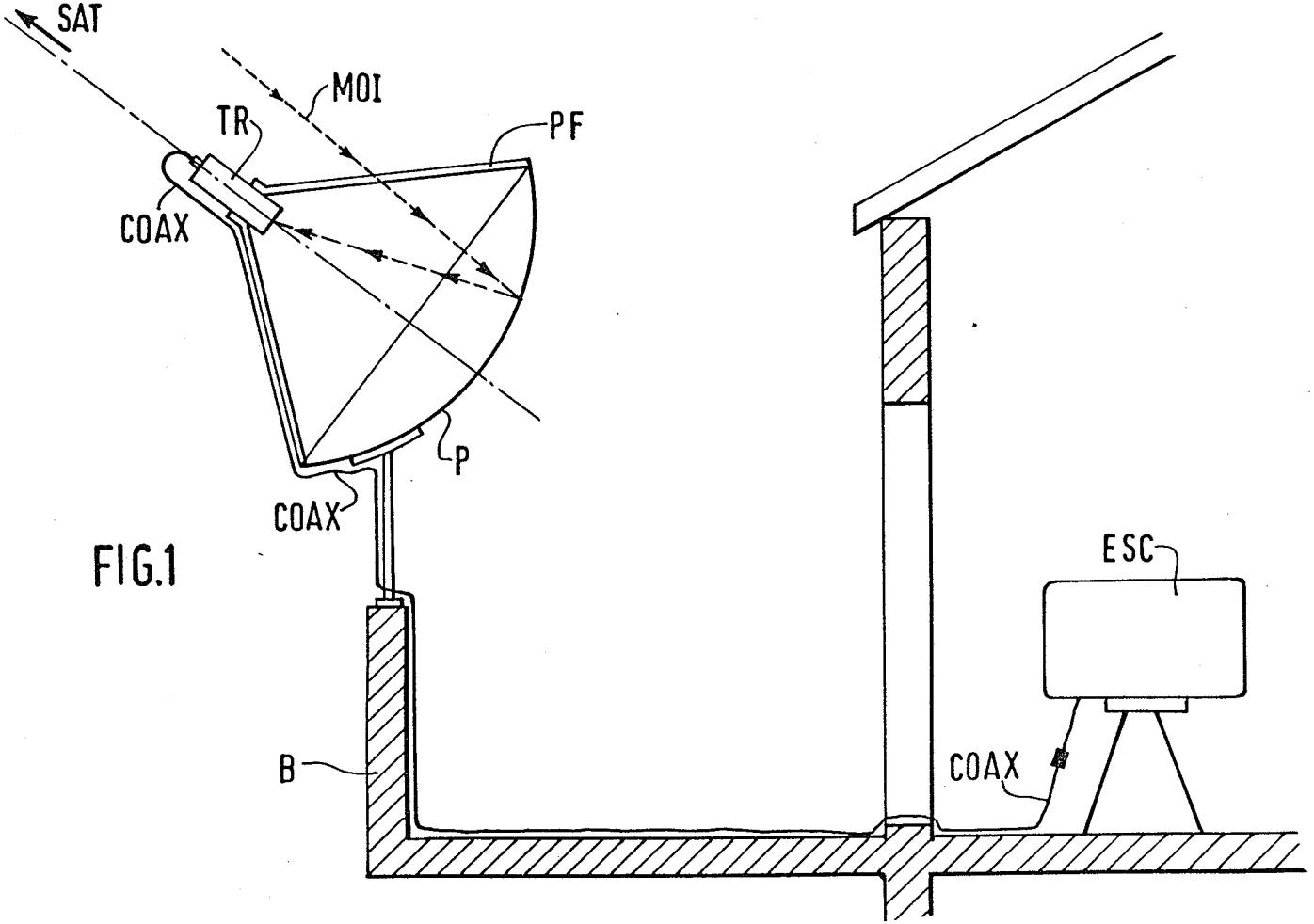
FIG. 1 shows a diagram of a receiving station.

FIG. 1 shows schematically a domestic receiving station at the subscriber's; the station comprises channel selection equipment (ESC) usually installed indoors, and a receiving head end (TR) installed in the focus and along the axis of the parabolic aerial (P) which is shown mounted on a balcony (B); the axis of the parabolic reflector points toward a satellite (SAT) in the direction of the arrow; the incident microwaves (MOI) are reflected to the focus of the parabola; the receiving head end (TR) forms the major part of the aerial as at that point the microwaves are collected for producing a usable electric signal; the electric signal is transmitted to the internal equipment (ESC) through a coaxial cable (COAX); the receiving head end (TR) is rigidly connected to the parabolic refelector usually by means of three mounting supports (PF).

The elements shown in FIG. 1 are well known, but it should be stressed that certain elements unintentionally have a detrimental effect on the proper functioning of the unit on account of the screen effect, or the shadow cast which they exercise between the microwaves and the parabola; the mounting supports (PF), the cable (COAX) and the receiving head end (TR) are meant here. It is clear that in order to reduce the price of the unit and improve the reception quality of the waves, it is advisable to reduce the weight, the bulkiness, the complexity of these elements while maintaining their operational quality; for example, by reducing the weight of the receiving head end (TR) it is possible to reduce its bulkiness and the dimensions of its supports (PF) and thus to reduce the shadow cast.

In the prior art aerials, such as the aerial described in the above Patent Specification, there are various movable parts, more specifically the converter, causing the above-mentioned drawbacks; the need of a powerful motor, cable twisting, . . . ; from other sources it is known to avoid the rotation of the converter to use the technology of the rotating joint which is used for the waveguide, but this technology is delicate because an electrical continuity has to be maintained during the rotation; this is an expensive solution and hence, it is not a satisfactory solution of the technical problem mentioned above.

It is an object of the invention to simplify the receiving heat end to provide a cheap, effective and durable consumer aerial.

This object is more specifically achieved by minimizing the number of movable components of the receiving head end and the shadow cast on the parabolic reflector.

According to the invention, a satisfactory receiving head end only comprises one movable component, the front depolarizer; in the case of a conventional depolarizer consisting of a dielectric sheet it is a light component which is easy to rotate with a small motor which is not very cumbersome.

Figure 2:
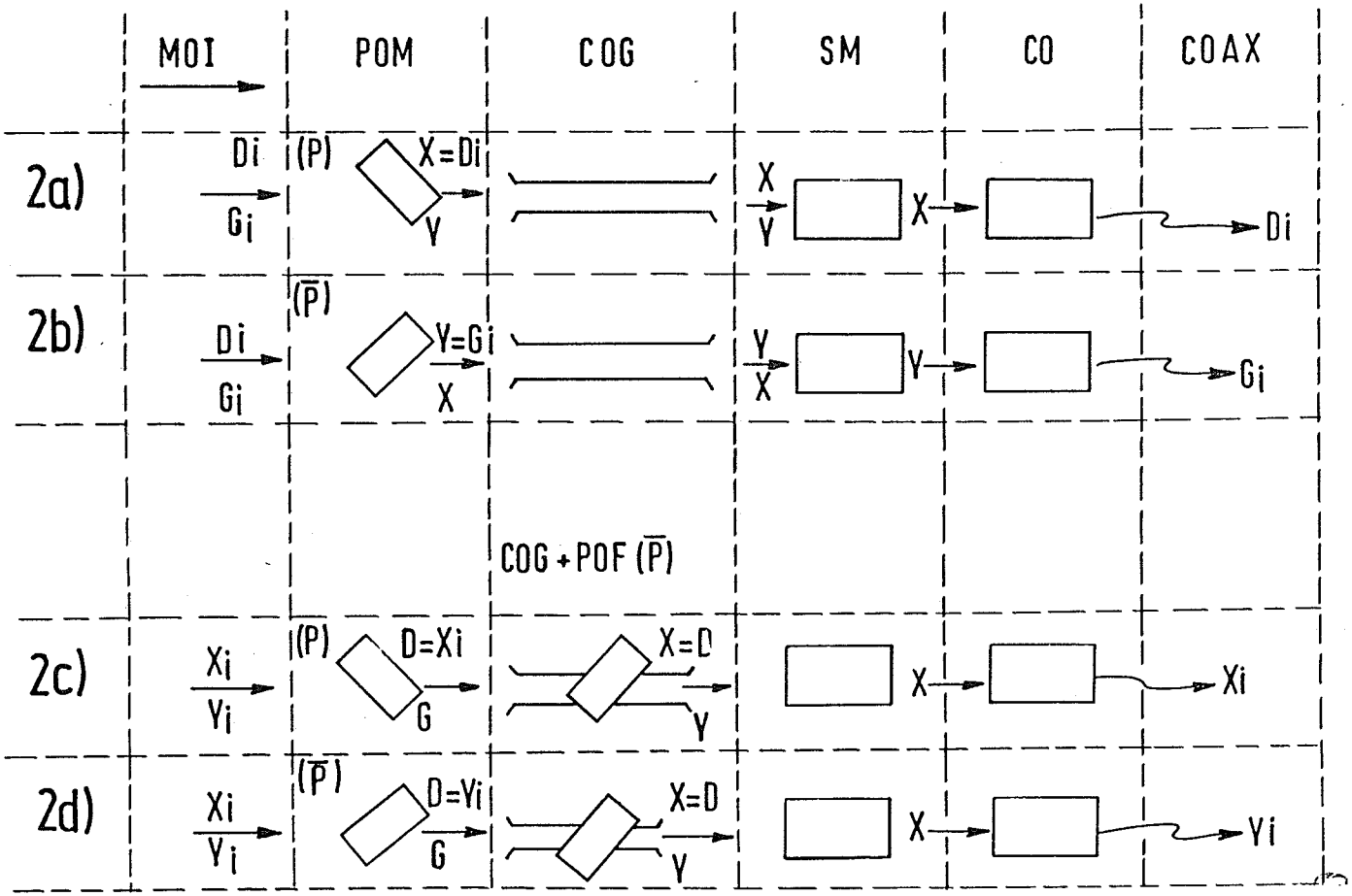
FIG. 2*a* through 2*d* show shows the two modes of operation of each of the two versions of the receiving head end in accordance with the invention.

A detailed description of the basic mode of operation of such an aerial is shown in FIG. 2 with its two versions according to the characteristics of the satellite which the aerial is pointed at.

The receiving head end (TR). comprises a movable front depolarizer (POM), a waveguide collector (COG), a mode selector (SM) and a converter (CO); the selected signal is electrically transmitted through the cable (COAX).

The Table below briefly shows the conversion of the waves in the depolarizer: the incident microwaves (MOI) leave the depolarizer as converted into output microwaves (MOS); the circular waves of two conjugate polarizations (D for right-hand and G for left-hand) become rectilinear waves of two conjugate polarization types (X for horizontal, Y for vertical) and vice versa; depending on the position of the polarizer/-depolarizer—the two positions P and $\overline{P}$ are $\pi/2$ apart—an incident wave Di becomes Y or X, respectively, an incident wave Gi becomes X or Y, respectively, etc.

| | MOS | |
|---|---|---|
| MOI | P = | P = |
| Di | Y | X |
| Gi | X | Y |
| Xi | D | G |
| Yi | G | D |

The two types of polarization, circular and rectilinear, are exclusive to each other.

The first version, FIGS. 2*a* and 2*b*, is suitable for a satellite which transmits microwaves (MOI) of a circular type having two possible conjugate incident polarizations, right-hand and left-hand (Di and Gi); at a specific moment the user is only interested in a single polarization, either Di or Gi; the invention makes use of this fact.

FIG. 2*a* shows how in a first position (P) of the movable depolarizer (POM) the incident circular waves (Di, Gi) becomes rectilinear waves (X, Y); after passing the waveguide (COG), the mode selector (SM) retains a single wave X which is converted by the converter (CO) into an electric signal which, in the case of FIG. 2*a* represents the righthand incident circularly polarized wave Di.

In the case of the FIG. 2*b*, similar to the case of FIG. 2*a*, but having a second position ($\overline{P}$) of the front depolarizer (POM), the electric signal now represents the left-hand incident circularly polarized wave Gi.

The FIGS. 2*c* and 2*d* correspond to the version of the receiving head end suitable for a satellite which transmits microwaves of a rectilinear type having two possible conjugate incident polarizations, namely horizontal and vertical (Xi and Yi); the construction of the receiving head end being identical to that of FIGS. 2*a* and 2*b*, except for the fact that in the waveguide collector (COG) a fixed depolarizer (POF) is added for realizing the change of type. The incident waves Xi, Yi become circularly polarized waves (D and G) while passing through the movable depolarizer (POM); the fixed depolarizer (POF) transforms these waves into (X and Y) such that the electric signal present on the cable (COAX) now represents the incident wave Xi in the case of FIG. 2*c*, and the incident wave Yi in the case of the FIG. 2*d*.

Realizing such a receiving head end with its two versions does not pose a particular problem as each individual component is simple and well known to a person skilled in the art; the technical progress realized by the invention actually lies in this simple fact of making use of a simple front depolarizer (POM) which is rotatable through an angle of $\pi/2$ around an axis with two operating positions, to which a further optional fixed depolarizer (POM) can be added or not; this simplified version is to approach the complex character of the designs known so far for solving the problem of receiving microwaves of different types of polarizations.

A considerable advantage lies in the fact that the cable (COAX is no longer twisted: on the one hand it is not damaged mechanically and on the other it can be fixed such that no shadow is cast.

A conventional dielectric-sheet depolarizer is preferably used rather than a meander-line depolarizer like the one described in the above Patent Specification.

A radome should preferably be placed around the movable depolarizer so that the inside of the receiving head end is protected from bad weather conditions.

Figure 3:
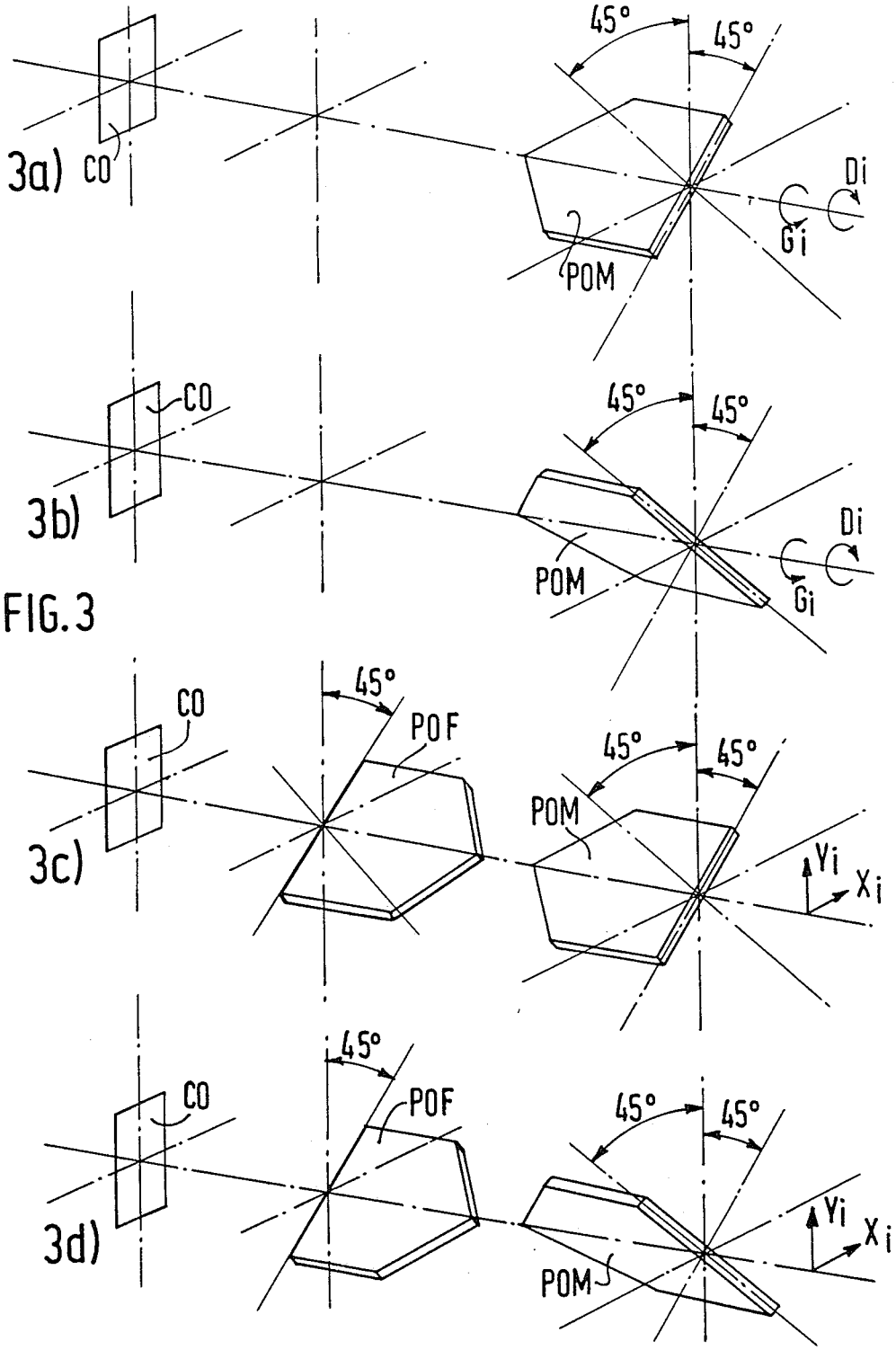
FIG. 3*a* through 3*d* show shows the positions of the elements of the receiving head end.

FIG. 3 shows the spatial configuration of the different receiving head end components.

FIGS. 3*a* and 3*b* show the two operating positions of the receiving head end for circularly polarized waves, that is to say with a single depolarizer.

FIGS. 3*c* and 3*d* show the two operating positions of the receiving head end for rectilinear waves, that is to say, with two depolarizers.

The plane of the fixed depolarizer (POF) is inclined through an angle of 45° with respect to the principal axis of the waveguide of the converter input (CO).

The plane of the movable depolarizer (POM) is shown either in the same plane as the fixed depolarizer (POF) as in FIGS. 3*a* and 3*c*, or in a plane perpendicular to the fixed depolarizer (POF) as in FIGS. 3*b* and 3*c*.

The depolarizers are shown here as thin dielectric plates having the form of a rectangle ending in a point; naturally, this representation is not limitative as there are already a great many more types of depolarizers, each type being selected more or less empirically as functions of multiple parameters: dimensions of the waveguide, and operating frequencies etc.

It is advantageous to mechanize the movement of the movable depolarizer; this mechanization itself does not cause any particular technical problem as a small motor will suffice because the movement is only impeded by rubbing.

Figure 4:
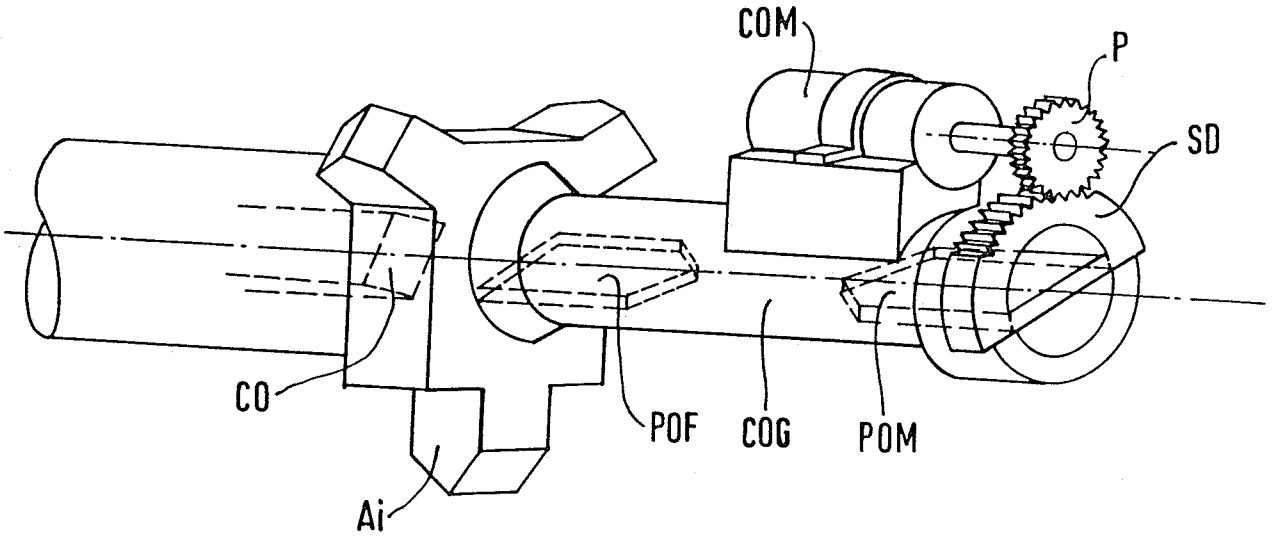
FIG. 4 shows a receiving head end in accordance with the invention.

A non-restrictive example of such an embodiment is shown in perspective in FIG. 4, only representing the receiving head end (TR) of FIG. 1.

The reference characters are the same as those of FIG. 2: mobile depolarizer (POM), waveguide collector (COG), optional fixed depolarizer (POF), converter (CO). The lugs (AI) correspond to the attachment points on the mounting supports (PF of the FIG. 1).

The control motor (COM) is attached directly to the body of the waveguide and a pinion (P) fixed along the axis of the motor meshes with a toothed segment (SD) rigidly locked with the mobile depolarizer (POM). The motor is controlled in a known manner by the selection equipment on the inside (ESC in FIG. 1). The toothed segment (SD) is a preferred embodiment with a motor which alternatively turns in either of the two directions and which automatically stops when the pinion (P) reaches the end of the toothed segment (SD) when detecting, for example, over consumption of current.

The toothed segment could in fact be a sprocket wheel with a motor turning in one single direction and an adequate device for stopping the motor when the movable depolarizer reaches the desired position.

It should be observed that a receiving head end in accordance with the invention is very compact, even with a motor, so that its shadow cast on the parabolic reflector is reduced considerably.

What is claimed is:

1. A head end for selectively receiving microwaves of different polarizations, said head end comprising, in order along an axis of propagation:

a. a movable depolarizer which is rotatable around the axis of propagation, through an angle of ninety degrees, to either:

(1) a position P for effecting the conversion of incident microwaves having polarizations Di, Gi, Xi, Yi to output microwaves having polarizations Y, X, D, G, respectively, (2) a position P' for effecting the conversion of incident microwaves having said polarizations Di, Gi, Xi, Yi to output microwaves having said polarizations X, Y G, D, respectively, where D represents a right-hand circularly-polarized microwave, G represents a left-hand circularly-polarized microwave, and where X and Y represent respective mutually-orthogonal rectilinearly-polarized microwaves;

b. a waveguide collector modifiable to either a first or second configuration, said first configuration effecting propagation of microwaves having the polarizations X, Y without converting said microwaves to a different polarization, said second configuration effecting propagation of microwaves having the polarizations D, G and conversion thereof to microwaves having the polarizations X, Y, respectively;

c. a mode selector for providing from the microwaves propagated by the waveguide collector selectively-available microwaves having either the X or Y polarization; and d. a converter for converting the microwaves provided by the mode selector to electrical signals representative thereof.

2. A head end as in claim 1 where the waveguide collector is in the first configuration and comprises a waveguide.

3. A head end as in claim 1 where the waveguide collector is in the second configuration and comprises a waveguide and a fixed depolarizer.

4. A head end as in claim 1 wherein the waveguide collector comprises a housing adapted to receive a depolarizer which can be installed to modify the waveguide collector from the first configuration to the second configuration.

5. An aerial including a parabolic reflector defining a focus and a head end disposed at said focus for selectively receiving microwaves of different polarizations, said head end comprising, in order along an axis of propagation.

a. a movable depolarizer which is rotatable around the axis of propagation, through an angle of ninety degrees, to either:

(1) a position P for effecting the conversion of incident microwaves having polarizations Di, Gi, Xi, Yi to output microwaves having polarizations Y, X, D, G, respectively, (2) a position P' for effecting the conversion of incident microwaves having said polarizations Di, Gi, Xi, Yi to output microwaves having said polarizations X, Y, G, D, respectively, where D represents a right-hand circularly-polarized microwave, G represents a left-hand circularly-polarized microwave, and where X and Y represent respective mutually-orthogonal rectilinearly-polarized microwaves;

b. a waveguide collector modifiable to either a first or second configuration, said first configuration effecting propagation of microwaves having the polarizations X, Y without converting said microwaves to a different polarization, said second configuration effecting propagation of microwaves having the polarizations D, G and conversion thereof to microwaves having the polarizations X, Y, respectively;

c. a mode selector for providing from the microwaves propagated by the waveguide collector selectively-available microwaves having either the X or Y polarization; and d. a converter for converting the microwaves provided by the mode selector to electrical signals representative thereof.

* * * * *